US009517378B2

(12) United States Patent
Ashby et al.

(10) Patent No.: US 9,517,378 B2
(45) Date of Patent: Dec. 13, 2016

(54) TREADMILL WITH FOOT FALL MONITOR AND CADENCE DISPLAY

(75) Inventors: Darren Ashby, Richmond, UT (US); Greg W. Law, Smithfield, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 673 days.

(21) Appl. No.: 13/565,439

(22) Filed: Aug. 2, 2012

(65) Prior Publication Data

US 2013/0035215 A1 Feb. 7, 2013

Related U.S. Application Data

(60) Provisional application No. 61/514,799, filed on Aug. 3, 2011.

(51) Int. Cl.
*A63B 22/02* (2006.01)
*A63B 24/00* (2006.01)

(52) U.S. Cl.
CPC ..... *A63B 22/0242* (2013.01); *A63B 22/025* (2015.10); *A63B 2024/0068* (2013.01); *A63B 2024/0093* (2013.01); *A63B 2220/17* (2013.01); *A63B 2220/51* (2013.01); *A63B 2220/808* (2013.01); *A63B 2220/833* (2013.01)

(58) Field of Classification Search
CPC ..... A63B 24/0062; A63B 22/02–22/0292
USPC ..... 482/54
See application file for complete search history.

(56) References Cited

U.S. PATENT DOCUMENTS 5,474,087 A * 12/1995 Nashner ..... 600/595
7,717,826 B2 * 5/2010 Cox ..... A61B 5/1038 482/8
7,914,420 B2 * 3/2011 Daly ..... A63B 22/0235 119/700
7,938,751 B2 * 5/2011 Nicolas et al. ..... 482/1
8,480,541 B1 * 7/2013 Brunts ..... A63B 22/0242 482/1
8,702,567 B2 * 4/2014 Hu ..... A61H 3/00 482/8

OTHER PUBLICATIONS

Cambridge Online Dictionary, http://dictionary.cambridge.org/us/dictionary/american-english/pendulum, last visited Nov. 30, 2014.*

* cited by examiner

*Primary Examiner* — Loan H Thanh
*Assistant Examiner* — Rae Fischer
(74) *Attorney, Agent, or Firm* — Holland & Hart LLP

(57) ABSTRACT

In general, the present invention discloses treadmills that include a monitor that detects foot falls of a person exercising on the treadmill. Various mechanisms are described that can be incorporated on a treadmill to detect foot falls. For example, load cells, vibration monitors, motor load variance monitors, and sound monitors can be used to detect foot falls. A processing unit on the treadmill can receive data from the foot fall monitor to calculate a cadence, or a number of foot falls per unit time. Information relating to cadence can be displayed to the person exercising. In addition to a foot fall monitor, the present invention also discloses a monitor that detects foot lifts of a person exercising on a treadmill. A processing unit can receive data from the foot fall and foot lift monitors to determine and display stride length.

13 Claims, 5 Drawing Sheets

TREADMILL WITH FOOT FALL MONITOR AND CADENCE DISPLAY

RELATED U.S. APPLICATIONS

This application claims priority from U.S. provisional application No. 61/514,799 filed on Aug. 3, 2011.

TECHNICAL FIELD

In general, the present invention relates to exercise devices. More specifically, the present invention relates to treadmills that can sense the foot falls of a user performing an exercise on the treadmill, convert that data into cadence, and display readable information reflecting the user's cadence.

BACKGROUND

Identifying "foot falls," or the contact between a person's foot and the ground, can provide a useful piece of information for those who exercise by walking as well as for more serious runners. For example, some people count the number of foot falls (or steps) that they take in a day in order to achieve a certain daily goal. Guidelines provide that healthy adults should take a total of approximately ten thousand steps every day. In order to monitor the total number of steps taken, some people wear a device, such as a pedometer, to track their steps.

Foot falls are also an important piece of information for runners. Specifically, some runners monitor their foot fall frequency or the number of footfalls per unit time (also referred to as "cadence"). For example, some runners may have a target number of foot falls per minute or other time unit that they try to achieve while running or jogging. Studies suggest that some of the world's fastest long-distance runners have a running cadence that is between eighty-five and ninety-five foot falls per minute. Achieving a higher cadence can increase a runner's speed while at the same time demand less energy. A high running cadence can also help to prevent injury. To monitor cadence, runners often wear a device that identifies foot falls and converts that data into a displayable cadence.

When weather or another factor prevents a person from running or walking outdoors, people often run or walk on a treadmill. As with running or walking outdoors, a person wanting to track their foot falls may need to wear a device to monitor foot falls while they exercise on a treadmill. Wearing a device to monitor foot falls, however, can be annoying and distracting. Further, the monitoring device may interfere with the user's natural running or walking motion.

Thus, there is a need for a treadmill that can sense the foot falls of a user performing an exercise, convert that data into a cadence, and display to the user information regarding cadence.

SUMMARY OF THE INVENTION

In one aspect of the disclosure, a treadmill includes a frame, a belt, a motor, a foot fall monitor, and a console.

In another aspect that may be combined with any of the aspects herein, the belt may be operatively associated with the frame and have an upwardly exposed exercise section.

In another aspect that may be combined with any of the aspects herein, the motor may be operatively associated with the frame and rotate the belt.

In another aspect that may be combined with any of the aspects herein, the foot fall monitor may be operatively associated with the frame and identify the foot falls of a user performing an exercise on the belt.

In another aspect that may be combined with any of the aspects herein, the console may be communicatively connected to the foot fall monitor.

In another aspect that may be combined with any of the aspects herein, the console may include a processing unit.

In another aspect that may be combined with any of the aspects herein, the processing unit calculates an actual cadence from data received from the foot fall monitor.

In another aspect that may be combined with any of the aspects herein, the console may include a display.

In another aspect that may be combined with any of the aspects herein, the display may show data reflecting the user's actual cadence.

In another aspect that may be combined with any of the aspects herein, the foot fall monitor may be a load cell.

In another aspect that may be combined with any of the aspects herein, the treadmill may further include a deck connected to the frame that provides support to the upwardly exposed section of the belt.

In another aspect that may be combined with any of the aspects herein, the foot fall monitor may be a vibration monitor that includes either a piezo electric component or a pendulum component to detect foot falls on the treadmill.

In another aspect that may be combined with any of the aspects herein, the foot fall monitor may be a motor load variance monitor that identifies spikes in voltage, current, or resistance to detect foot falls on the treadmill.

In another aspect that may be combined with any of the aspects herein, the foot fall monitor may be a sound monitor that identifies increases in sound to detect foot falls on the treadmill.

In another aspect that may be combined with any of the aspects herein, the treadmill may further include an input mechanism, which a person may use to input information regarding a target cadence.

In another aspect that may be combined with any of the aspects herein, the treadmill may include an indicator that provides a signal that relates to the target cadence.

In another aspect that may be combined with any of the aspects herein, the treadmill may further include a light that illuminates when the actual cadence is at or within an acceptable margin of the target cadence.

In another aspect that may be combined with any of the aspects herein, the treadmill may further include a light that illuminates when the actual cadence is outside of an acceptable margin of the target cadence.

In another aspect that may be combined with any of the aspects herein, the treadmill may further include a light that flashes at the frequency of the target cadence.

In another aspect that may be combined with any of the aspects herein, the treadmill may further include a speaker that emits a sound at the frequency of the target cadence.

In another aspect that may be combined with any of the aspects herein, the treadmill may include an indicator that provides a signal that relates to the target cadence.

In another aspect that may be combined with any of the aspects herein, the treadmill may include multiple strain gauges that are operatively associated with the treadmill deck, to detect foot falls and foot lifts of a person exercising.

In another aspect that may be combined with any of the aspects herein, the processing unit calculates stride length from data received from the strain gauges.

In another aspect that may be combined with any of the aspects herein, the display shows data reflecting the user's stride length.

DETAILED DESCRIPTION

The present invention provides a treadmill that can sense the foot falls of a person exercising on the treadmill, thus eliminating the need for the person exercising to wear a pedometer or other device to sense footfalls. The treadmill can also convert the foot fall data into a cadence and display that information to the person exercising.

Unless specified or limited otherwise, the terms "connected" and "associated with" are used broadly and encompass both direct and indirect connections and associations. Further, these terms are not restricted to mechanical attachments but also include frictional, adhesive, magnetic and other attachments.

Figure 1:
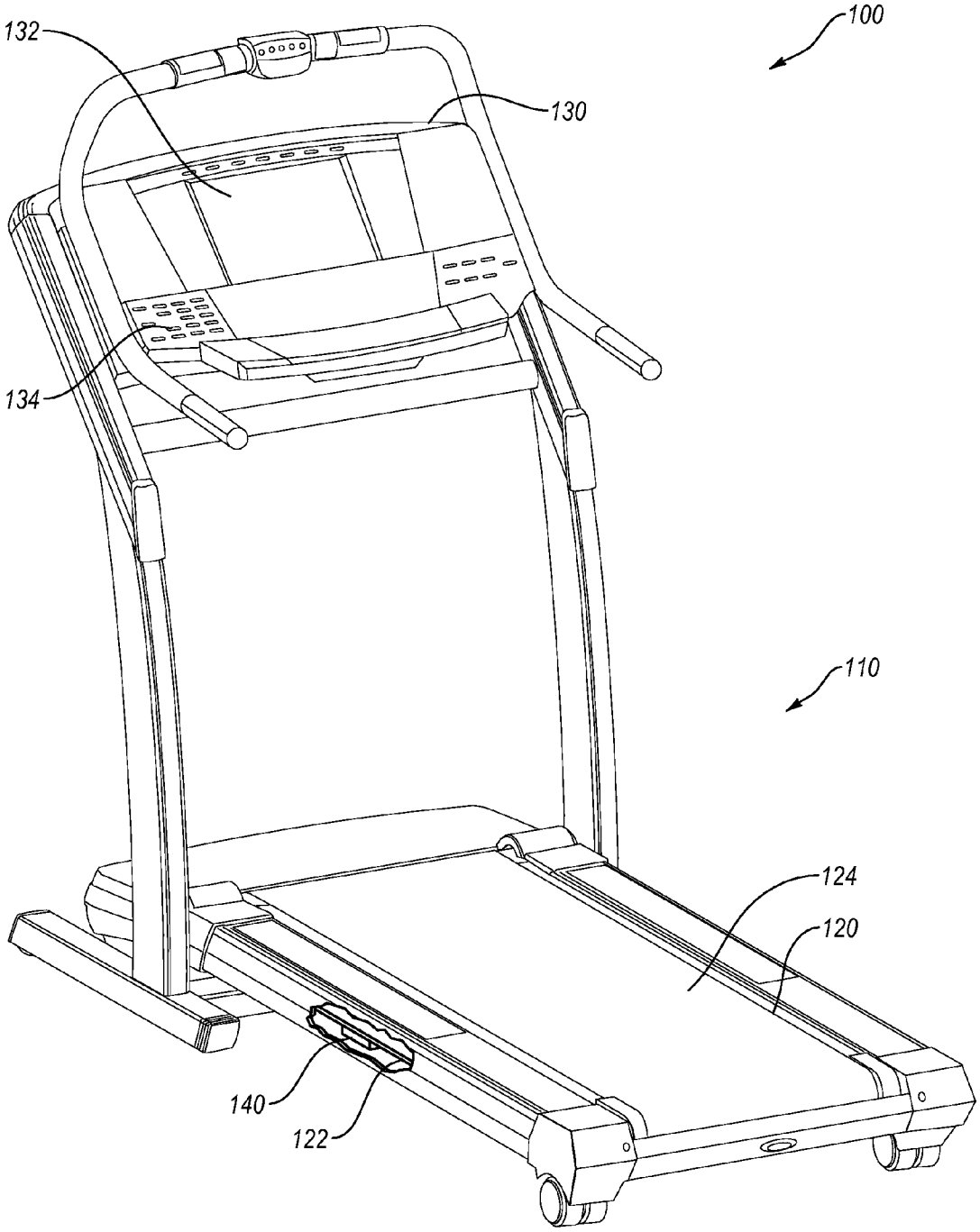
FIG. 1 illustrates a perspective view of a first embodiment of the present invention.

FIG. 1 illustrates one embodiment of the present invention. Specifically, FIG. 1 illustrates a treadmill 100. Treadmill 100 includes a frame 110. A frame can be any part of an exercise device that imparts structural support and/or stability to a treadmill. Treadmill 100 also includes a belt 120 and a flexible deck 122. Belt 120 is operably associated with frame 110. Belt 120 has an upwardly exposed section 124, which is positioned above deck 122 to provide a surface upon which a person using treadmill 100 may walk or run. The foot falls of a person exercising on treadmill 100 cause deck 122 to flex or bend in certain places. This flexing or bending of deck 122 may be selectively adjustable and can help to prevent injury and make the exercise more comfortable. A belt motor (not shown) is also included on treadmill 100. The belt motor is configured to rotate belt 120 and can also be operatively associated with frame 110.

Treadmill 100 further includes a console 130. Console 130 can include a display screen 132, which can display a wide variety of exercise-related data or entertainment for a user who is exercising on treadmill 100. Console 130 also includes buttons 134 that can be used to control one or more of the parameters (e.g., speed, incline) of treadmill 100, or to select a programming option provided by treadmill 100. As discussed in more detail in connection with FIG. 3, a console used in connection with the present invention can include a display for providing information relating to a person's cadence and buttons for identifying a target cadence.

Figure 3:
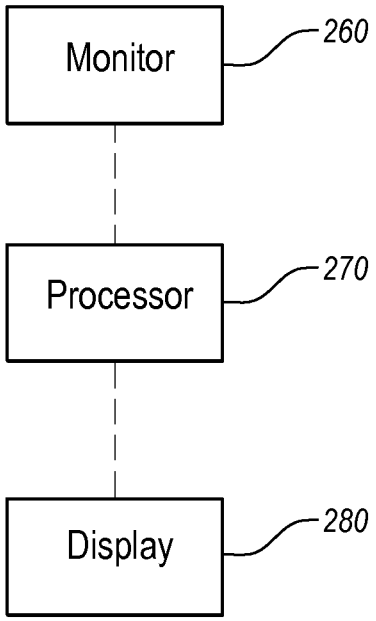
FIG. 3 illustrates a block diagram of components that can be used in connection with the present invention.

Console 130 also includes a processing unit (see FIG. 3). A processing unit can be a computer, a microprocessor, a microcontroller, state machine or other similar device that includes circuitry for controlling the operation of one or more features on an exercise device. For example, the processing unit on treadmill 100 may receive input from buttons or another source regarding the speed of the belt. The processing unit may be housed within console 130 or in another location on treadmill 100. In alternative embodiments, a processing unit may be external to treadmill 100. Processing units may also convert exercise-related data into a format that is displayable to a user. For example, a processing unit may convert data regarding movement of belt 120 into a numerical figure representing speed or distance, which can be displayed on display 132.

Treadmill 100 also includes a foot fall monitor 140. Foot fall monitor 140 can be any device that senses a user's foot falls on belt 120 of treadmill 100. For example, in the illustrated embodiment, foot fall monitor 140 is a load cell connected to the bottom side of deck 122. More specifically, foot fall monitor 140 is a strain gauge. As stated previously, deck 122 is configured to bend and flex in certain places as a person exercising on treadmill 100 plants and lifts their feet from belt 120. Often, the decks on treadmills are most flexible at or near the forward end of the deck, where a person's foot falls normally occur during a workout. The deck is often stiffest at or near the rearward end of the deck, where a person exercising is normally lifting their feet during a workout. Foot fall monitor 140 is located near the forward end of deck 122 where a person normally plants his or her feet while exercising on treadmill 100.

The electrical resistance within foot fall monitor 140 changes as it is stretched or bent. Thus, connecting foot fall monitor 140 to the underside of deck 122 in the approximate location where a person's foot falls normally occur during a workout causes foot fall monitor 140 to bend or stretch with deck 122 and with the foot falls of a person exercising on treadmill 100. By monitoring the change in electrical resistance within foot fall monitor 140, the foot falls of a person exercising on treadmill 100 can be detected.

Figure 1A:
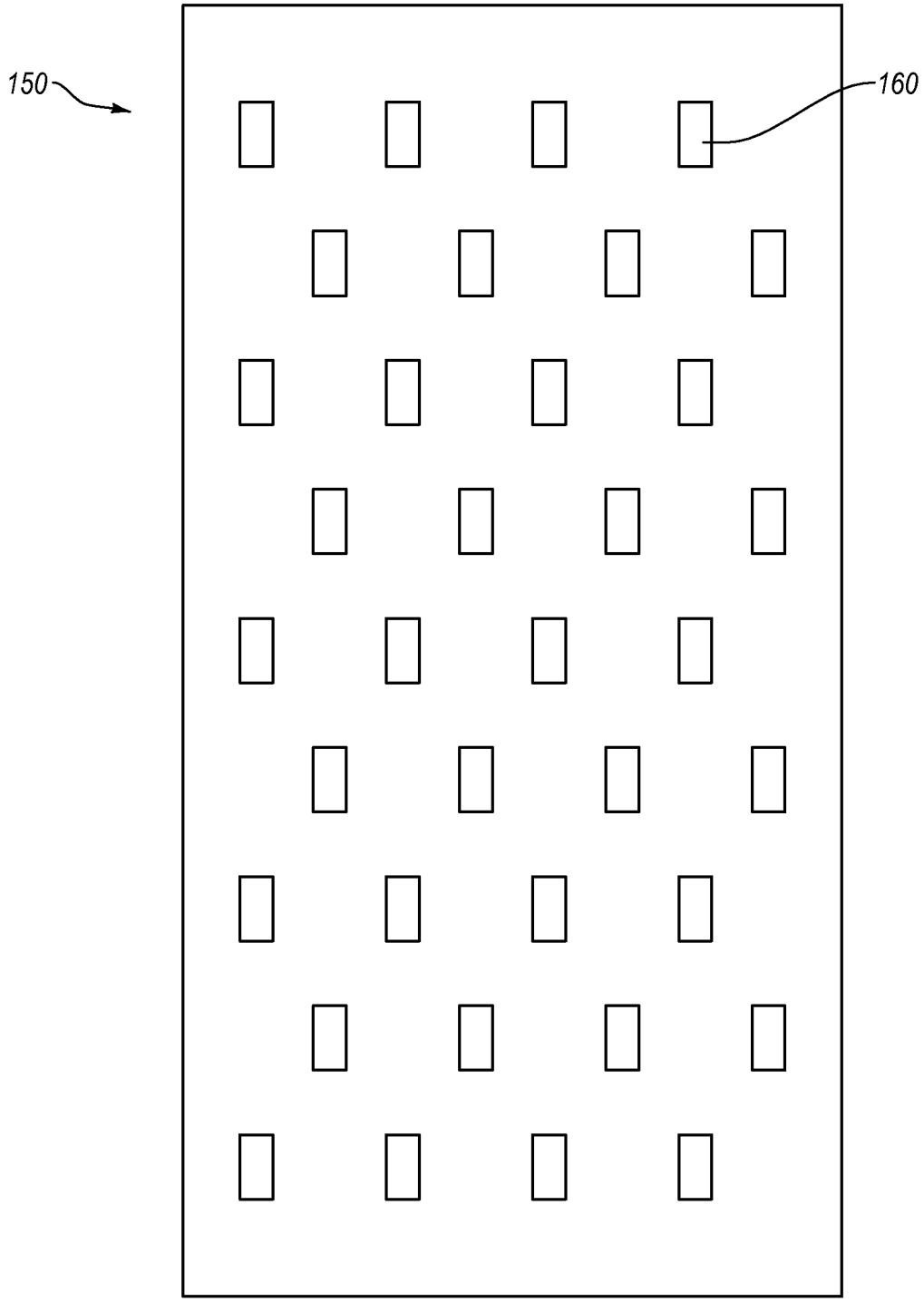
FIG. 1A illustrates a bottom plan view of a treadmill deck for use in the present invention.

If an adequate number of load cells are placed in appropriate places on a treadmill deck, information in addition to a person's foot falls may be detected. For example, FIG. 1A illustrates a bottom plan view of a treadmill deck 150. Treadmill deck 150 includes multiple foot fall monitors, in the form of load cells 160, which are spaced about the bottom surface of deck 150. Load cells 160 can be strain gauges. Load cells 160 can sense not only the foot falls of a person walking or running on deck 150, they can also sense where on deck 150 foot falls are occurring. As stated previously, cushioning and possibly other properties of treadmill decks can vary from the forward end to the rearward end and between each side. In order to take advantage of, for example, a more flexible forward portion of a treadmill deck and a stiffer rearward portion of a treadmill deck, the exercising person must be properly positioned on the deck. A treadmill incorporating deck 150 may alert an exercising person if he or she is too far back, forward, or too far to either side, of deck 150.

In addition, a treadmill incorporating deck 150 could regulate the speed of a belt associated with deck 150 based on a person's position on the deck. For example, a treadmill incorporating deck 150 could automatically increase the speed of the belt when a person exercising is too far forward on deck 150. The treadmill could automatically decrease the speed of the belt when a person exercising is too far back on deck 150. Thus, a treadmill that incorporates deck 150 may automatically reposition a user on the treadmill by adjusting the speed to match the user's walking or running speed.

Load cells 160 can also sense the location on deck 150 of a person's foot lifts. A foot lift is the place on a deck where a person exercising lifts his or her feet. Sensing both the place of the person's foot falls and foot lifts on deck 150 may allow, via a processing unit, for the calculation of the exercising person's stride length. Stride length, like cadence, can be an important piece of information. A treadmill incorporating deck 150 could display to the exercising person his or her stride length. In another implementation, a person could input a target stride length into the treadmill incorporating deck 150. The treadmill could provide a visual or audible alert to the person exercising if his or her stride length falls outside of an acceptable margin of the target stride length.

Figure 2:
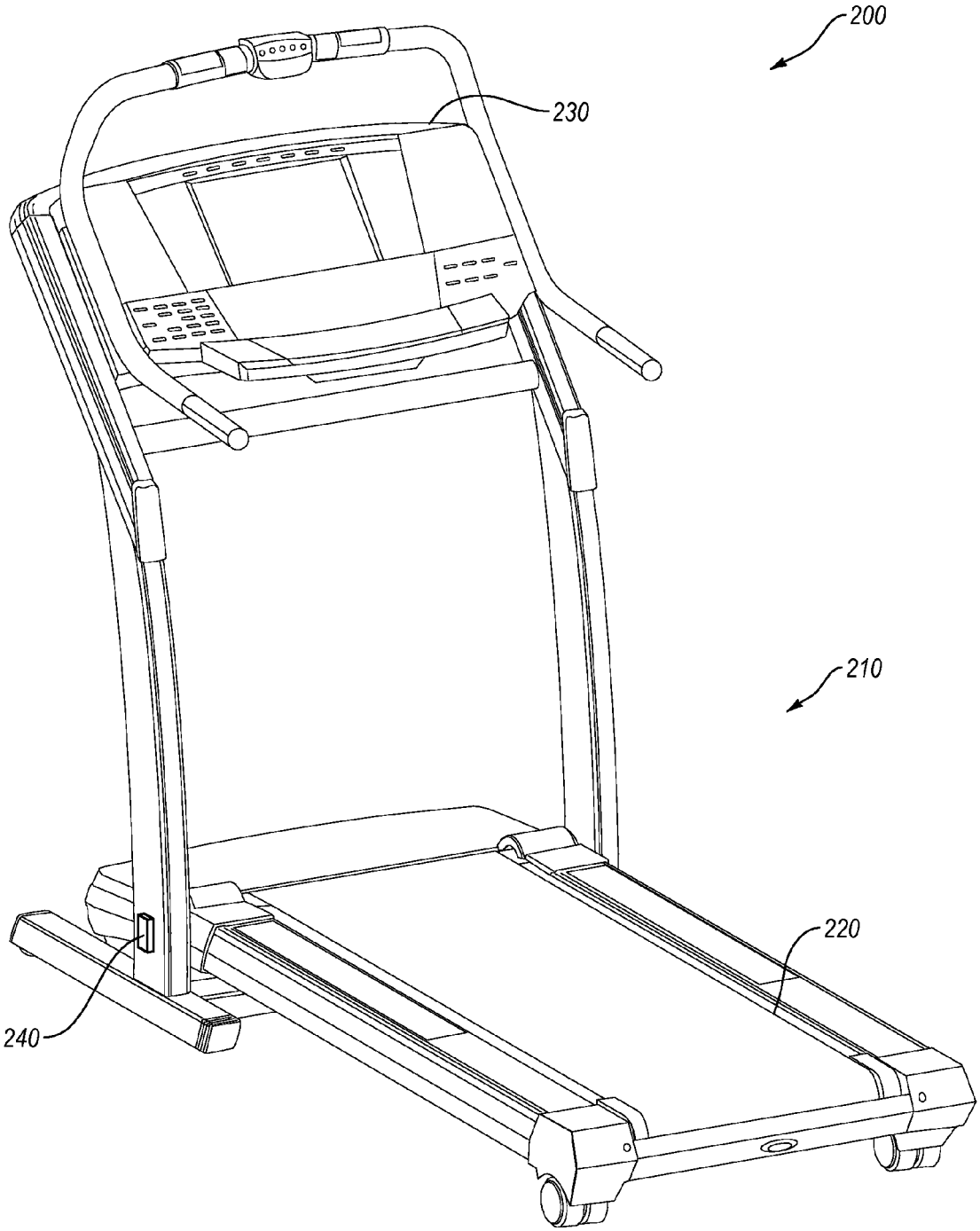
FIG. 2 illustrates a perspective view of a second embodiment of the present invention.

FIG. 2 illustrates another embodiment of the present invention. Specifically, FIG. 2 illustrates a treadmill 200. As with treadmill 100, treadmill 200 includes a frame 210, a belt 220, a motor (not shown), a console 230, and a foot fall sensor 240. Foot fall sensor 240 on treadmill 200 is a vibration monitor. Foot fall monitor 240 is mounted to the frame 210 of treadmill 200. Foot fall monitor 240 can sense the foot falls of a person exercising on treadmill 200 based on the vibration created in treadmill 200, which are caused by the person's foot falls.

Foot fall monitor 240 can sense the vibration created by a person's foot falls in a number of different ways. For example, foot fall monitor 240 could include a piezo electric component (or an accelerometer). A change in voltage within a piezo electric component is created when it is stretched or compressed. A weight may be mounted on the top of the piezo electric component to increase the compression on the piezo electric component that results from the vibration created by a foot fall. By monitoring the change in voltage within the piezo electric component, the foot falls of a person exercising on treadmill 200 can be detected. Foot fall monitor 240 could also include a pendulum component. The pendulum component can be configured to move or oscillate with a vibration of treadmill 100 that is created by the foot falls of a person performing an exercise on treadmill 200. The movement of the pendulum component can be monitored to detect the foot falls of a person exercising on treadmill 200.

Regardless of the mechanism employed by the foot fall monitor to sense the foot falls of a person exercising on a treadmill, data from the foot fall monitor can be sent to the treadmill processing unit. The processing unit includes circuitry that can be used to convert the data received from the foot fall monitor to an actual cadence, or a number of foot falls per unit time. For example, the processing unit can convert the foot fall data from the foot fall monitor to a number of foot falls per minute. The cadence data calculated by the processing unit can also be displayed on a console display.

FIG. 3 illustrates a block diagram showing the relationship between a monitor 260, a processing unit 270, and a display 280. The processing unit 270 is communicatively connected to the monitor 260. This connection may include a wire or the connection may be wireless. The processing unit 270 is also communicatively connected to the display 280. This connection may also be a wired or wireless connection.

Figure 4:
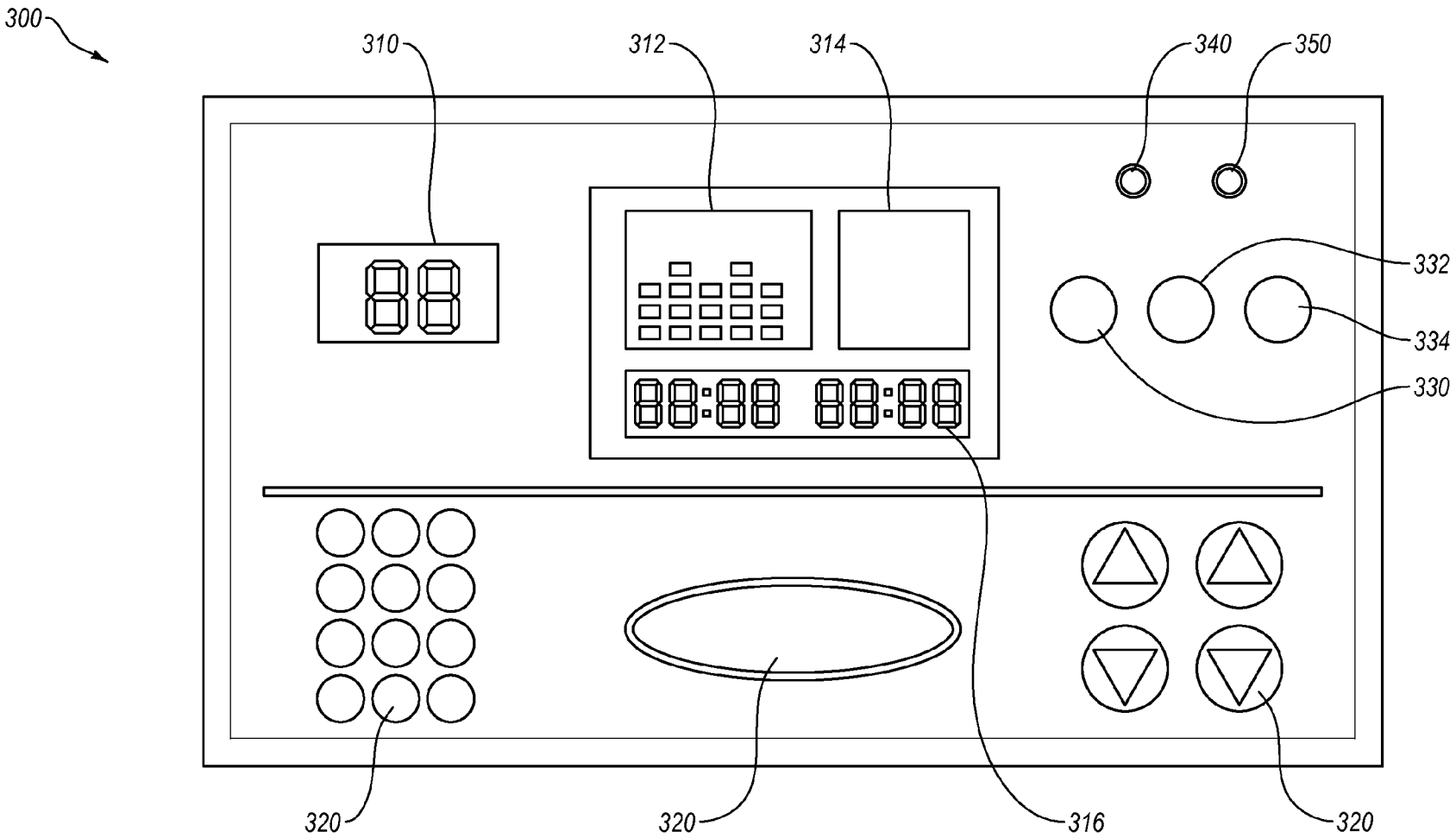
FIG. 4 illustrates a front view of a console for use in the present invention.

FIG. 4 illustrates treadmill console 300, which can be used in connection with the present invention. Console 300 includes displays 310, 312, 314 and 316. Displays 310, 312, 314, and 316 can be any type of display that provides a visual indication of workout information. Display 310, for example, is an alphanumeric light emitting diode display or liquid crystal display that shows the cadence of a person exercising on the treadmill to which console 300 is attached. Displays 312, 314, 316 may provide exercise related and/or entertainment information, such as speed, distance, difficulty level, incline, video, television, and the like.

Console 300 also includes buttons 320. Among other uses, these buttons can be used to input a person's target cadence. For example, if a person wants to achieve ninety foot falls per minute during his or her exercise routine, he or she can input that information into the processing unit through buttons 320. The person's target cadence can be shown on one or more displays on console 300. Having viewing access to target cadence and actual cadence on console 300 allows a person exercising to know whether he or she is maintaining the desired cadence by comparing the two numbers.

To assist a person in achieving his or her target cadence, console 300 may also include an indicator that communicates to a person exercising whether he or she is at a target cadence. For example, console 300 includes lights 330, 332, and 334. Light 332 can be illuminated if the person exercising is at, or within an acceptable margin of, his or her target cadence. An acceptable margin can be any percentage of target cadence. For example, light 332 can be illuminated if the person exercising is within five percent or less of his or her target cadence. Light 330 can be illuminated if the person exercising is below an acceptable margin of his or her target cadence. For example, light 330 can be illuminated if the person exercising is more than five percent below the target cadence. Light 334 can be illuminated if the person exercising is above an acceptable margin of his or her target cadence. For example, light 334 can be illuminated if the person exercising is more than five percent above the target cadence. Based upon which light is illuminated, the person exercising knows whether he or she must maintain, increase, or decrease his or her foot fall rate in order to be at the target cadence.

In addition to or in place of lights 330, 332, and 334, a console may also include an intermittent indicator that communicates the target cadence to the person during his or her workout. For example, console 300 includes a visual intermittent indicator 340. Visual intermittent indicator 340 is a light that flashes at a rate that is equal to the person's target cadence. In order to achieve the target cadence, the person may match his or her foot falls to the light flashing rate of visual intermittent indicator 340.

Alternatively or in addition to visual intermittent indicator 340, console 300 may include an audio intermittent indicator 350. Audio intermittent indicator 350 is a speaker that emits a sound (e.g., a beep, chirp, ring . . . ) at a rate that is equal to the person's target cadence. In order to achieve the target cadence, the person may match his or her foot falls to the rate of the sound emitted by audio intermittent indicator 350.

INDUSTRIAL APPLICABILITY

In general, the present invention relates to treadmills that sense the foot falls of a person exercising, convert that data into a cadence, and display cadence related information to the person exercising. Cadence differs significantly from a running total of number of foot falls (or steps). Cadence provides information regarding the exercising person's efficiency of movement. If a person's cadence is too high or too low, energy is being wasted. This may result in a slower speed and increase the chance for an injury. Thus, cadence is an important piece of information, especially for more serious runners.

Step counters or pedometers merely provide a total of number of steps that a person has taken. Step counters do not provide any information regarding a person's walking or running efficiency. Step counters also do not provide any information regarding the potential for injury of a person walking or running.

Conventional cadence and step counter monitors often require that a person secure a monitoring device to his or her body. These monitors can be annoying and distracting and can interfere with the natural movement of the person wearing the device. Unlike these conventional devices, treadmills of the present invention sense a person's foot falls and calculate cadence without any need for the person exercising to secure anything to their bodies.

Various types of foot fall monitors may be used to detect the foot falls, and optionally the foot lifts of a person exercising on a treadmill. For instance, a strain gauge may be used to sense the foot falls of a person exercising on a treadmill. The strain gauge(s) may be placed at various locations on the deck of the treadmill, including those portions of the deck that bend with the foot falls or foot lifts of a person working out. For example, the strain gauge(s) may be located on the bottom, top, or a side surface of the treadmill deck. Strain gauges need not be placed on the treadmill deck, but may be positioned on another part of the treadmill that bends with the foot falls of a person exercising. For example, a strain gauge may be placed on a part of the treadmill frame.

Strain gauges are one example of load cells. In addition to strain gauges, other load cell devices that could be used to sense foot falls may include hydraulic load cells, diaphragm load cells, spool type load cells and ring type load cells. Load cells that sense a compression force may be located between components of the treadmill that bear the weight of a person exercising and where pressure increases with the foot falls of a person exercising. For example, a load cell that senses compression forces may be located between the treadmill frame and the support surface on which the treadmill rests.

Another example of foot fall monitors includes vibration monitors that may also be used to sense the foot falls of a person exercising on a treadmill. Vibration monitors may be connected to any part of the treadmill that vibrates or shakes with the foot falls of a person exercising. For example, a vibration monitor may be connected to the frame of the treadmill, the treadmill deck, the treadmill console, or another place.

Load cells and vibration monitors are not the only type of foot fall monitors that can sense the foot falls of a person exercising on a treadmill. Foot fall monitors can also include devices that sense load variations on the motor that rotates the treadmill belt. Foot falls on the treadmill belt cause the electrical current drawn by the motor rotating the belt to spike. This spike in current can be detected through circuitry that measures the current being drawn by the motor. In response to the spike in current caused by a foot fall, and to maintain the speed of the treadmill belt, the amount of voltage supplied to the motor is changed. In alternative embodiments, the change in voltage supplied to a motor could be monitored to detect foot falls of a person exercising on the treadmill.

Foot fall monitors can also include microphones or other sound sensing device that can detect a spike in sound or decibel level from the foot falls of a person exercising on a treadmill. A microphone or other sound sensing device can be positioned on the treadmill in a location that is sufficiently proximate to detect the sound spikes, such as on the deck or adjacent to the treadmill belt.

A person may input exercise related data, including a target cadence, into the treadmill through inputs such as buttons, knobs, levers, and switches. Actual and target cadence can be displayed on any part of a treadmill. For example, displays on a treadmill may be dedicated to displaying actual and target cadence. Alternatively, a single display may be used to display both target and actual cadence. In this embodiment, a user may toggle back and forth between actual and target cadence, or the treadmill may automatically toggle back and forth between actual and target cadence on a set timed schedule. Further, the display and input mechanism may not be separate devices. Such is the case with consoles having a touch-screen display.

The invention claimed is:

1. A treadmill comprising:

a frame;

a belt operatively associated with the frame, the belt having an upwardly exposed exercise section;

a motor operatively associated with the frame, the motor being configured to rotate the belt;

a foot fall monitor operatively associated with the frame, wherein the foot fall monitor is configured to identify the foot falls of a user performing an exercise on the belt;

a processing unit that is communicatively connected to the foot fall monitor, wherein the processing unit is configured to calculate an actual cadence of the user from data received from the foot fall monitor;

wherein the foot fall monitor is configured to detect a horizontal position of the user relative to the frame; and wherein the treadmill is configured to regulate a speed of the belt based on the detected horizontal position of the user relative to the frame.

2. The treadmill of claim 1, further comprising a console that includes an input mechanism to input information regarding a target cadence; and at least one display disposed in the console, wherein the at least one display is communicatively connected to the processing unit, and wherein the at least one display is configured to display data reflecting the actual cadence.

3. The treadmill of claim 2, wherein the at least one display is configured to display data reflecting the target cadence.

4. The treadmill of claim 3, wherein the data reflecting the target cadence is a display of the target cadence.

5. The treadmill of claim 2, wherein the console further includes a light configured to illuminate to signal that either the actual cadence is at or within an acceptable margin of the target cadence or that the actual cadence is outside of an acceptable margin of the target cadence.

6. The treadmill of claim 2, wherein the console further includes a light configured to illuminate to signal that either the actual cadence is within five percent of the target cadence or that the actual cadence is not within five percent of the target cadence.

7. The treadmill of claim 2, wherein the console further includes a light configured to flash at the rate of the target cadence.

8. The treadmill of claim 2, wherein the console further includes a speaker configured to emit a sound at the rate of the target cadence.

9. A treadmill comprising:

a frame;

a belt operatively associated with the frame, the belt having an upwardly exposed exercise section;

a motor operatively associated with the frame, the motor being configured to rotate the belt;

a foot fall monitor operatively associated with the frame, wherein the foot fall monitor is configured to identify the foot falls of a user performing an exercise on the belt;

a console that is communicatively connected to the foot fall monitor, the console including a processing unit, a display, an input mechanism, and an indicator;

wherein the processing unit is configured to calculate actual cadence of the user from data received from the foot fall monitor;

wherein the display shows data reflecting the user's actual cadence;

wherein the input mechanism may be used to input information regarding a target cadence;

wherein the indicator is configured to provide a signal that relates to the target cadence; and wherein the foot fall monitor is configured to detect a horizontal position of the user relative to the frame; and wherein the treadmill is configured to regulate a speed of the belt based on the detected horizontal position of the user relative to the frame.

10. The treadmill of claim 9, wherein the indicator is a display that is configured to show data reflecting the target cadence.

11. The treadmill of claim 9, wherein the indicator is a light that is configured to flash at the rate of the target cadence.

12. The treadmill of claim 9, wherein the indicator is a speaker configured to emit a sound at the rate of the target cadence.

13. A treadmill comprising:

a frame;

a deck connected to the frame;

a belt operatively associated with the frame and having an upwardly exposed exercise section that is supported by the deck;

a motor operatively associated with the frame, the motor being configured to rotate the belt;

a foot fall monitor operatively associated with the deck, wherein the foot fall monitor is configured to detect foot falls of a person exercising on the belt;

a foot lift monitor operatively associated with the deck, wherein the foot lift monitor is configured to detect foot lifts of a person exercising;

a console that is communicatively connected to the foot fall monitor and the foot lift monitor, the console including a processing unit and at least one display;

wherein the processing unit is configured to calculate a user's stride length from data received from the foot fall and foot lift monitors;

wherein the display is configured to show data reflecting the user's stride length; and wherein the foot fall monitor is configured to detect a horizontal position of the user relative to the frame; and wherein the treadmill is configured to regulate a speed of the belt based on the detected horizontal position of the user relative to the frame.

* * * * *